US005239134A

United States Patent [19]

Pote et al.

[11] Patent Number: 5,239,134

[45] Date of Patent: Aug. 24, 1993

[54] METHOD OF MAKING A FLEXIBLE COAXIAL CABLE AND RESULTANT CABLE

[75] Inventors: William T. Pote, Glen Gardner; Roger Johansen, South Plainfield; Thomas Pote, Gladstone, all of N.J.

[73] Assignee: Flexco Microwave, Inc., Port Murray, N.J.

[21] Appl. No.: 916,211

[22] Filed: Jul. 17, 1992

Related U.S. Application Data

[62] Division of Ser. No. 727,589, Jul. 9, 1991.

[51] Int. Cl.[5] ..... H01B 7/18

[52] U.S. Cl. ..... 174/102 R; 29/828; 156/50; 156/51; 174/28; 174/29; 174/102 D

[58] Field of Search ..... 174/21 C, 28, 29, 110 R, 174/102 R, 102 D, 102 SO, 105 R, 106 D, 107; 156/50, 51, 244.18, 244.19; 29/828; 30/90.1

[56] References Cited

U.S. PATENT DOCUMENTS

| | | | |
|---|---|---|---|
| Re. 30,194 | 1/1980 | Bruno et al. | 174/28 |
| 2,348,641 | 5/1944 | Parker | 174/102 D |
| 2,890,263 | 6/1959 | Brandes et al. | 174/29 |
| 2,995,616 | 8/1961 | Nicolas | 174/102 D |
| 3,002,047 | 9/1961 | Mammella | 174/124 R |
| 3,173,990 | 3/1965 | Lamons | 174/102 R |
| 3,287,490 | 11/1966 | Wright | 174/102 D |
| 3,582,536 | 6/1971 | Miller | 174/102 D |
| 3,797,104 | 3/1974 | Pote | 174/102 D X |
| 4,011,118 | 3/1977 | Geominy | 174/28 X |
| 4,181,486 | 1/1980 | Saito | 156/55 X |
| 4,346,253 | 8/1982 | Saito et al. | 174/29 |
| 4,730,088 | 3/1988 | Suzuki | 174/102 R |
| 4,758,685 | 7/1988 | Pote et al. | 174/29 |

FOREIGN PATENT DOCUMENTS

| | | |
|---|---|---|
| 752006 | 9/1933 | France . |
| 616303 | 5/1946 | United Kingdom . |

*Primary Examiner*—Morris H. Nimmo
*Attorney, Agent, or Firm*—Bryan Cave

[57] ABSTRACT

An improved method for making a flexible coaxial cable having an inner conductor (36) to which a dielectric material is secured to form a dielectric core (30) for the coaxial cable (38), and a flexible outer conductor (50) such as one formed from a strip helically wound conductor (58), employs a solid dielectric starting material (32), such as a spline dielectric or a cylindrical dieletric or an expanded dielectric, which is controllably cut, such as by saw blades (34), using a desired cutting angle ($\theta$) and blade width ($\alpha$), in order to cut away a predetermined amount of the solid dielectric starting material (32) to provide a shaped dielectric core (30), such as a spiral or helix (30*a*, 30*b*), from the solid dielectric starting material (32). The resulting core (30), such as single or double helix (30*a*, 30*b*), which has a predetermined pitch which provides a desired predetermined velocity of propagation and impedance for the coaxial cable (38), is inserted into the convoluted outer conductor (50) to produce a fast cable (38) without any locking of the core (30) to the outer conductor (50). However, to provide additional stability to the flexible coaxial cable (38), the core (30) may be locked to the outer conductor (50) by any of numerous locking methods. By calculating in advance the type of cut to be made to the solid dielectric starting material (32) and the amount of dielectric material to be removed, various parameters such as impedance, velocity of propagation or phase length, attenuation, and VSWR, associated with the resulting flexible coaxial cable (38), may be readily controlled.

12 Claims, 9 Drawing Sheets

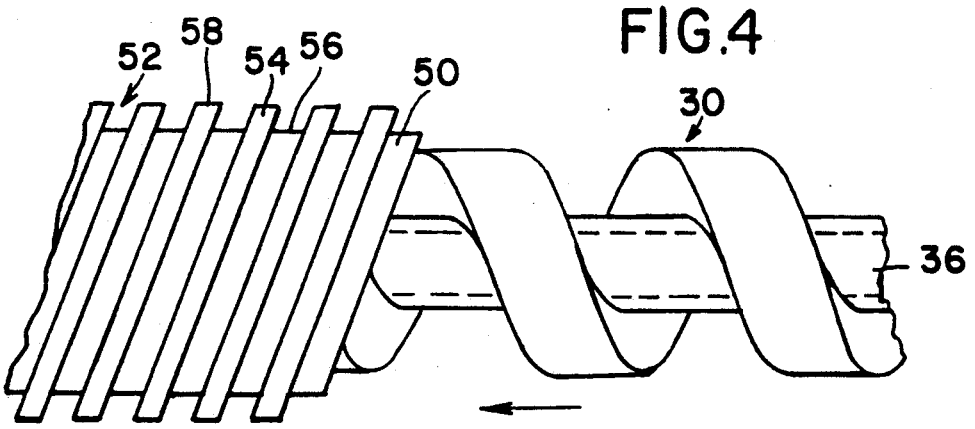
FIG.4
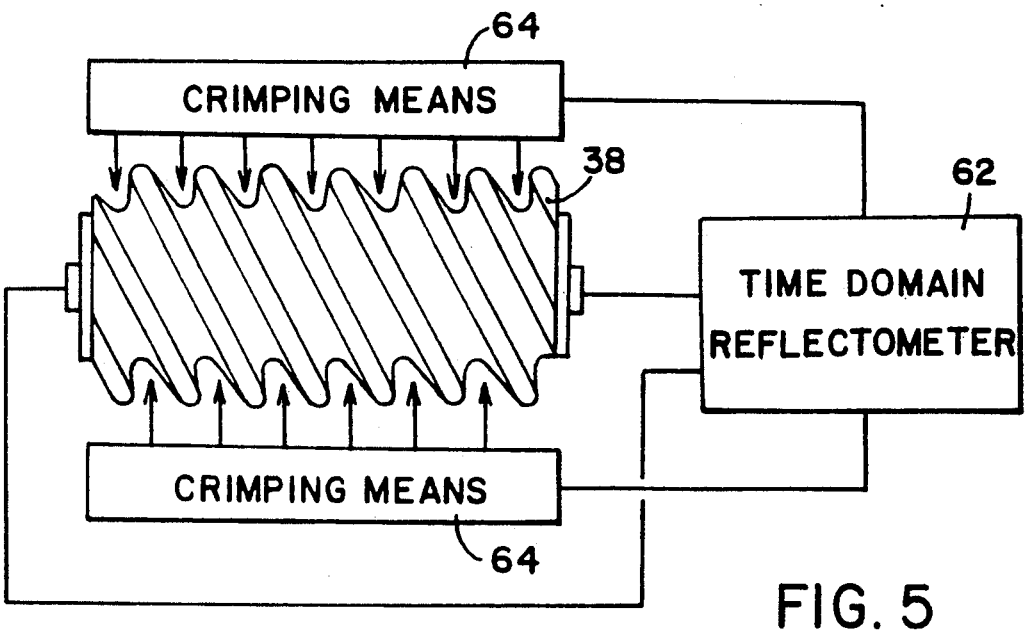
FIG. 5
FIG. 6
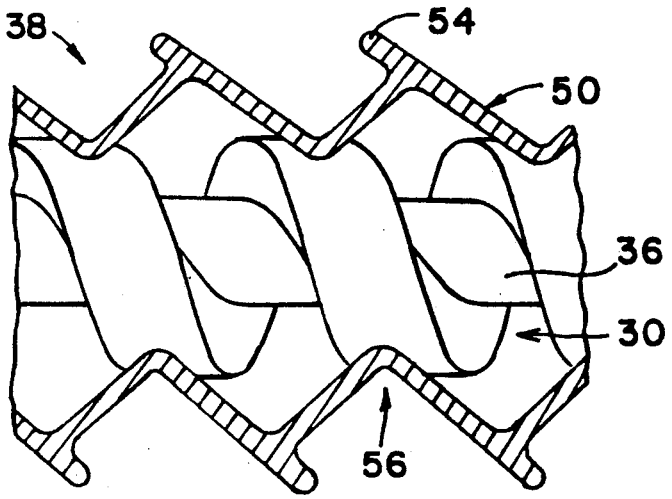

ATTENUATION

VSWR

METHOD OF MAKING A FLEXIBLE COAXIAL CABLE AND RESULTANT CABLE

This application is a division of U.S. application Ser. No. 07/727,589, filed Jul. 9, 1991.

CROSS-REFERENCE TO RELATED APPLICATIONS

This application is related to commonly owned prior U.S. Pat. No. 3,797,104, naming William T. Pote as sole inventor, and U.S. Pat. No. 4,758,685 naming William T. Pote and Robert Landsman as joint inventors thereof, both of which are entitled "Flexible Coaxial Cable and Method of Making Same," and is an improvement thereon. This application is also related to the contemporaneously filed, commonly owned, copending U.S. patent application entitled "Method of Making Flexible Coaxial Cable Having Threaded Dielectric Core," naming William T. Pote as the sole inventor thereof, the contents of which are specifically incorporated by reference herein in their entirety.

TECHNICAL FIELD

The present invention relates to improvements in the methods of making flexible coaxial cables and the resultant improved cables made by such methods.

BACKGROUND ART

Coaxial cables, such as for microwave transmission, have existed in the prior art for a considerable period of time. As technology has developed, a need for flexible coaxial cables whose electrical characteristics do not vary during flexure of the cable, such as in aerospace utilizations, has developed. In such utilizations, often the electrical characteristics of the cable are critical and any variation therein will yield unsatisfactory transmissions via such cables. In order to increase the flexibility of prior art coaxial cables, corrugated outer conductors, such as disclosed in U.S. Pat. Nos. 3,582,536; 3,173,990 and 2,890,263 have been utilized. In addition, other prior art attempts of providing such flexibility have employed a corrugated outer sheath for the cable rather than a corrugated outer conductor, such as disclosed in U.S. Pat. No. 3,002,047. Furthermore, this concept of a corrugated outer sheath has been utilized for standard electrical cables, as opposed to coaxial cables, where such cables are exposed to considerable flexure, such as disclosed in U.S Pat. Nos. 2,348,641 and 2,995,616.

In order to ensure electrical stability for a coaxial cable, the relative location between the various portions of the outer conductor, the dielectric and the inner conductor must remain constant during flexure of the cable or the electrical characteristics may vary. Prior art attempts to ensure this stability have involved the locking of a corrugated outer conductor to the dielectric surrounding the inner conductor, such as disclosed in U.S. Pat. No 3,173,990 wherein such inner conductor is a foam polyethylene. However, such prior art flexible coaxial cables do not have sufficient flexibility nor do they have sufficient temperature stability, which also affects the electrical characteristics. These prior art coaxial cables utilize either a tube which is crimped to provide a corrugated tube or form the outer conductor by means of helically winding a piece of conductive material, welding the adjacent pieces together to then form a tube and, thereafter, crimping alternate longitudinal portions so as to provide a corrugated tube. In both instances, the maximum pitch for the convolutions of the outer conductor is severely limited. In the first instance, this limitation is primarily due to rupture of the conductive tube if the crimps are too closely spaced together whereas, in the second instance, the limitations are primarily due to the inability to sufficiently control the thickness of the resultant tube which is formed as a thin enough material cannot be utilized to produce a high pitch. Since the higher the pitch of the convoluted outer conductor, the greater the flexiblity of the coaxial cable, these prior art flexible coaxial cables have not been satisfactory where large degrees of flexure are required together with electrical and temperature stability over a wide range of flexure.

Furthermore, these prior art flexible coaxial cable have primarily been of the foam polythylene or solid dielectric type whereas flexible coaxial cables utilizing spline dielectrics have not exhibited satisfactory electrical and temperature stability characteristics.

These disadvantages of the prior art have been overcome to an extent by the prior invention of U.S. Pat. No 3,797,104 employing a solid dielectric. However, the ability to provide flexible coaxial cables for certain applications in which a particular velocity of propagation or lower attenuation was required was somewhat limited as was the ability to readily change the velocity of propagation of the flexible coaxial cable to the desired value during manufacture. Moreover, although there have been prior art attempts to use helically wound dielectrics for coaxial cable, such as disclosed in U.S. Pat. No. 4,346,253; French Patent No. 752,006 and British Patent No. 616,303, they have not been satisfactorily employed for flexible coaxial cables, particularly since any change in pitch of the helically wound dielectric during flexing of the cable would undesirably change the properties of the cable. These disadvantages of the prior art have been overcome to some extent by the prior invention of U.S. Pat. No. 4,758,685 employing a heat shrinkable dielectric tubing surrounding a helically wound dielectric beading. However, the process of manufacturing such a flexible coaxial cable is difficult and necessarily can lend itself to instabilities, such as if the shrinking were non-uniform thereby resulting in a non-uniform dielectric core which could cause problems in inserting the core into the outer conductor, and resultant electrical instability due to the locking of a non-uniform core. These disadvantages of the prior art are overcome by the present invention which provides an easily controllable manufacturing process, which yields a highly stable flexible coaxial cable in which the characteristics of the cable can readily be controlled during the manufacturing process.

DISCLOSURE OF THE INVENTION

An improved method for making a flexible coaxial cable having an inner conductor to which a dielectric material is secured to form a dielectric core for the coaxial cable, and a flexible outer conductor, such as a convoluted outer conductor formed from a strip helically wound conductor, employs a solid dielectric starting material, such as a spline dielectric, or a cylindrical dieletric, or an expanded dielectrics which is controllably cut, such as by saw blades, using a desired cutting angle and blade width, in order to cut away a predetermined amount of the solid dielectric starting material to provide a shaped dielectric core, such as a spiral or helix, from the solid dielectric starting material. The resulting shaped core, such as single or double helix, has a resultant predetermined pitch which provides a desired predetermined velocity of propagation and impedance for the coaxial cable. The resulting helically shaped core is inserted into the convoluted outer conductor to produce a fast cable without any locking of the core to the outer conductor. However, to provide additional stability to the flexible coaxial cable, the core may be locked to the outer conductor by any of numerous locking methods, such as by way of example, the mechanical crimping method of the type described in prior U.S. Pat. Nos. 3,797,104 and 4,758,685, or the threadable locking method of the type described in the aforementioned contemporaneously filed copending U.S. Patent application entitled "Method of Making Flexible Coaxial Cable Having Threaded Dielectric Core." By calculating in advance the type of cut to be made to the solid dielectric starting material and the amount of dielectric material to be removed, various parameters such as impedance, velocity of propagation or phase length, attenuation, and VSWR, associated with the resulting flexible coaxial cable, may be readily controlled using the improved method of the present invention.

BRIEF DESCRIPTION OF THE DRAWINGS

FIG. 4 is a diagrammatic illustration of the insertion step for inserting the cut dielectric core into the convoluted outer conductor in accordance with the presently preferred improved method of the present invention;

FIG. 5 is a diagrammatic illustration of a typical mechanical crimping step, such as disclosed in U.S. Pat. No. 3,797,104, for mechanically locking the inserted cut dielectric core to the convoluted outer conductor in accordance with the improved method of the present invention;

FIG.6 is a cross-sectional view of a preferred embodiment of a flexible coaxial cable produced by the improved method of the present invention in which the mechanical locking step of FIG. 5 has been employed;

BEST MODE FOR CARRYING OUT THE INVENTION

Figure 1:
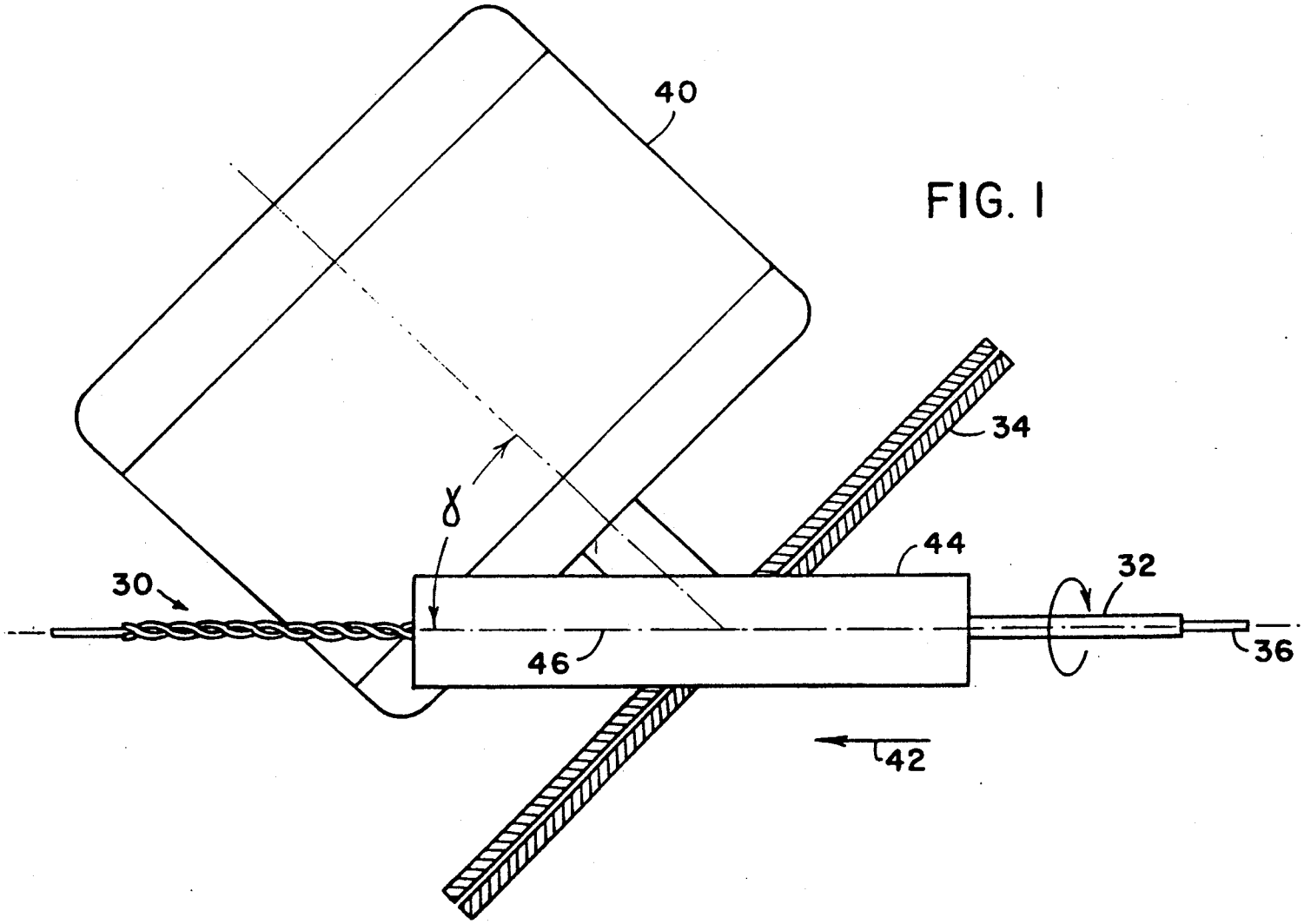
FIG. 1 is a diagrammatic illustration of the presently preferred dielectric cutting step in accordance with the presently preferred improved method of the present invention in which a typical solid cylindrical dielectric starting material is being cut to form a spiral or helix dielectric core.

Referring now to the drawings in detail, and initially to FIGS. 1–12, the presently preferred improved method of the present invention shall be described. As discussed in commonly owned U.S. Pat. No. 4,758,685, a spiral or helix type dielectric core for a flexible coaxial cable enables the velocity of propagation, by way of example, to be readily controlled during manufacture in accordance with the pitch of the helix, which also affects the impedance of the dielectric core. However, the method employed in U.S. Pat. No. 4,758,685, for providing this dielectric core involves the use of a heat shrinkable dieletric tubing over a helically wound dielectric beading which can result in a non-uniform dielectric core. As shown and preferred in FIGS. 1 and 2, by way of example, the spiral or helix dielectric core 30 in the present invention, is preferably formed from a solid dielectric starting material 32 which is preferably cut by adjustable saw blades 34 at a predetermined cutting angle $\theta$, using saw blades 34 of a predetermined cutting width $\alpha$ which effectively determines the web width $\beta$ for the resultant spiral dielectric core 30. The dielectric starting material 32 is preferably initially provided with a conventional inner conductor 36 which comprises the center conductor 36 for the resultant flexible coaxial cable 38. The dielectric starting material 30 is preferably secured to the inner conductor 36, such as by bonding during the extrusion process, so that it is locked to the inner conductor 36.

Figure 2:
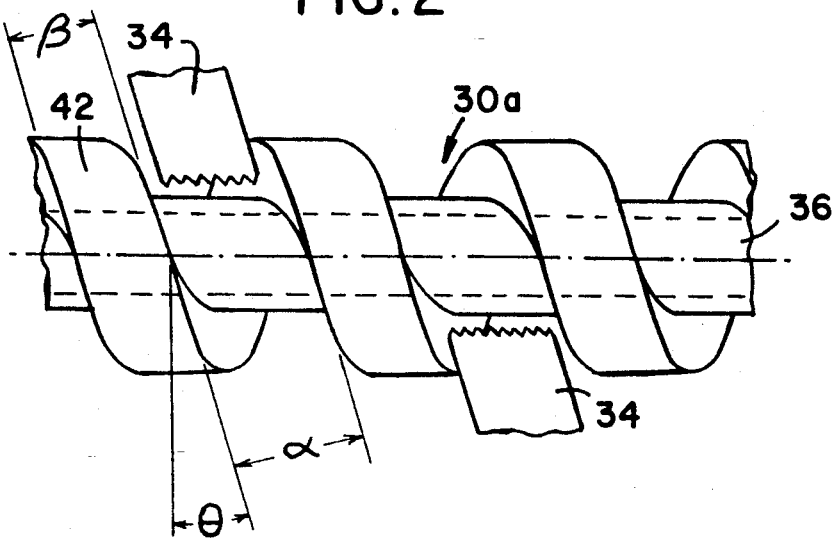
FIG. 2 is a diagrammatic illustration of a single helix dielectric core provided by the cutting step illustrated in FIG. 1 in accordance with the presently preferred improved method of the present invention.
Figure 11:
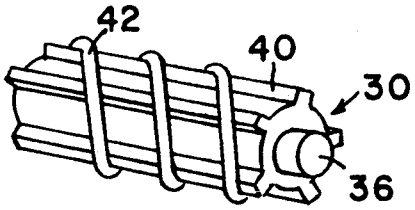
FIG. 11 is a diagrammatic illustration of a typical spline dielectric which has been cut in accordance with the improved method of the present invention to form a helix dielectric core.
Figure 12:
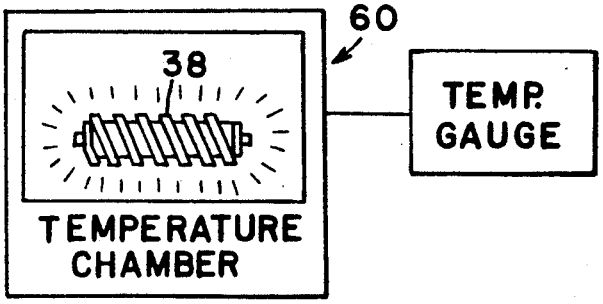
FIG. 12 is a diagrammatic illustration of the step of temperature cycling the flexible coaxial cable between at least a pair of predetermined temperature extremes in accordance with the improved method of the present invention.
Figure 7:
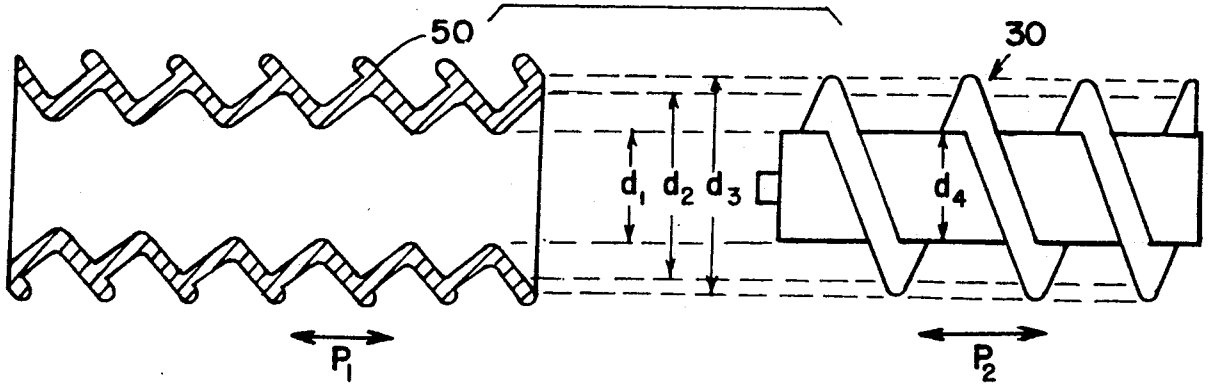
FIGS. 7 and 8 are diagrammatic illustrations of a typical threadable locking step, such as disclosed in the commonly owned contemporaneously filed copending U.S. patent application entitled "Method of Making Flexible Coaxial Cable Having Threaded Dieletric Core," for threadably locking the inserted dielectric core to the convoluted outer conductor in accordance with the improved method of the present invention.

As shown by way of example in FIGS. 1 and 2, the solid dielectric starting material is cylindrical in shape although it can be any desired shape such as, for example, triangular, and may even comprise a spline 40, such as shown in FIG. 11, which is then cut to provide the spiral or helix dielectric core 30 which is comprised of the spiral web 42 of web width $\beta$, by way of example, of a predetermined pitch determined by the cutting angle $\theta$ and cutting width $\alpha$. These parameters determine the amount of dielectric material which is cut away or removed from the solid dielectric 3 which effectively changes the impedance Z and the velocity of propagation V, as well as the VSWR and attenuation, such as shown in FIGS. 13–21 to be described in greater detail hereinafter.

Figure 17:
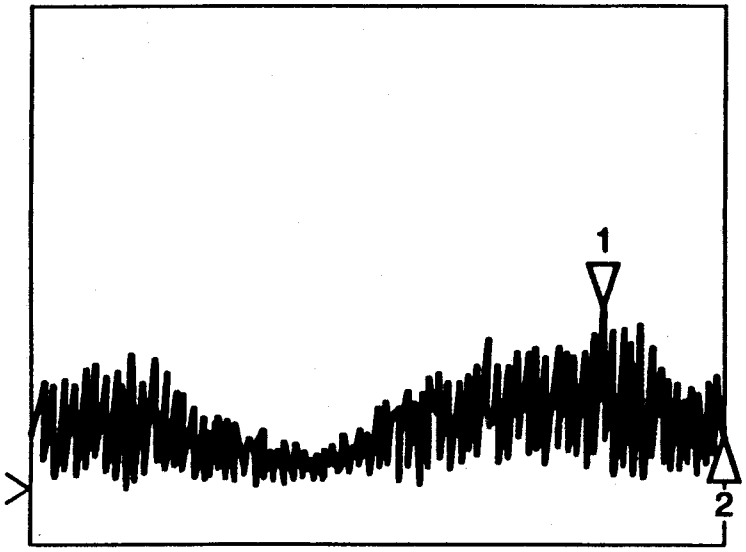
FIG. 17 is a graphical illustration of the VSWR curve for the cable of FIG. 16.

For example, with respect to the single helix dielectric core 30*a* illustrated in FIG. 2, for a dielectric starting material 32 having an initial outer diameter of 0.126 inches, and a starting impedance of 42.1 ohms, the resultant impedance of the spiral dielectric core 30*a* is controllably changed to 50.9 ohms by employing the method of the present invention by utilizing a cutting width $\alpha$ of 0.128 inches for the saw blades 34, adjusted at a cutting angle of 36°10′, to provide a web width $\beta$ of 0.50 inches, with a pitch of 0.214 inches and a pitch diameter of 0.095 inches. It should be noted that the shape of the cut produced by saw blades 34 affects the frequency range and whether or not moding occurs which would result in high VSWR peaks or spikes at certain high frequencies, with the effect on VSWR being illustrated by way of example in FIGS. 17 and 20 which shows a lower VSWR after the controlled spiral cut (FIG. 20) than before (FIG. 17).

Figure 3:
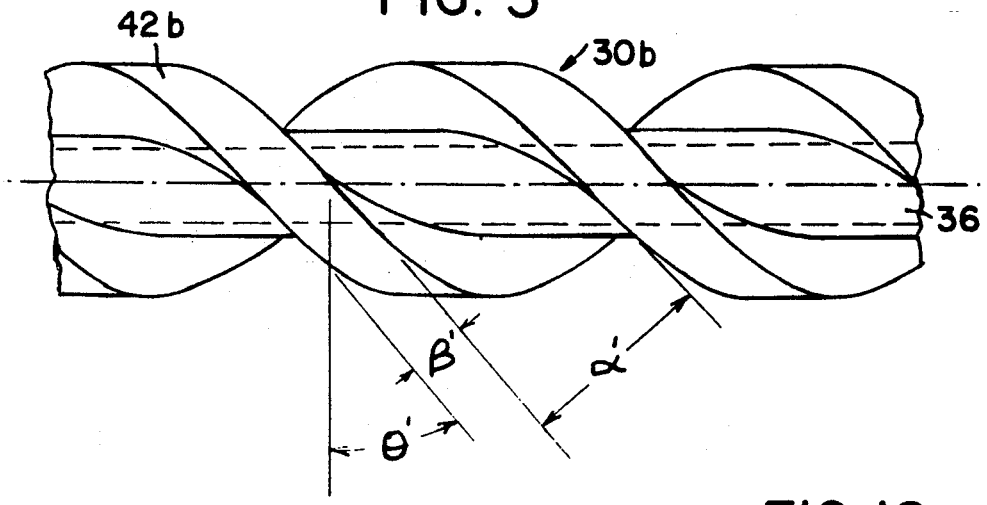
FIG. 3 is a diagrammatic illustration of a double helix dielectric core provided by the cutting step illustrated in FIG. 1 in accordance with the presently preferred improved method of the present invention.

Of course, if it is desired to extend the frequency range of the resultant flexible coaxial cable 38 and decrease the possibility of moding at higher frequencies, a double shaped spiral or helix 30*b*, such as illustrated in FIG. 3, can be employed in place of the single spiral 30*a* of FIG. 2 for the spiral cut dielectric core 30. In this instance, the method of the present invention is still basically the same with the saw blades 34 instead being adjusted to cut a double helix 30*b* from the solid dielectric starting material 32. In the example shown in FIG. 3, using the same diameter dielectric starting material 32 as in FIG. 2, and a starting impedance of 44.1 ohms, the resultant impedance of the double helix spiral dielectric core 30*b* is controllably changed to 51.5 ohms by employing the method of the present invention by utilizing a cutting width $\alpha'$ of 0.075 inches for the saw blades 34, adjusted at a cutting angle $\theta'$ of 45°30′, to provide a web width $\beta'$ of 0.046 inches, with a pitch of 0.297 inches and a pitch diameter of 0.108 inches.

In both instances, in carrying out the preferred method of the present invention, the saw blades 34 are preferably circular jewelers saw blades which may be used to cut a solid dielectric starting material of Teflon, TFE, FEP or polyolefin, by way of example, and are conventionally motor driven by a motor 40, such as at a rate of approximately 3600 rpm, while the solid dielectric starting material 32 is rotated and driven or pushed or pulled past the rotating saw blades 34 in the direction of arrow 42 through holder 44 to provide the spiral cut dielectric core 30. As shown and preferred, the cutting angle $\alpha$ may readily be adjusted by adjusting the angle $\gamma$ of the saw blades 34 with respect to the holder 44 longitudinal axis 46 along which the dielectric starting material 32 is pulled or driven as it is rotated past the saw blades 34.

Of course, if desired, although a spiral dielectric core 30 is shown and presently preferred, other variations of shapes and styles may be produced using the method of the present invention which will transmit RF energy efficiently while increasing the velocity of propagation and adjusting the impedance. This may be accomplished by changing the amount of blades 34 and their respective widths and the space there between.

In any event, in determining the quantity of dielectric material to be cut away from the solid dielectric starting material 32, the desired impedance Z and the desired velocity of propagation V are determined by utilizing the following formulas:

$$Z = \frac{138\mathrm{LOG}_{10}\frac{b}{a}}{\sqrt{Ke}}$$

where Z=impedance, Ke=dielectric constant, b=electrical diameter of the outer conductor 48, and a=electrical outer diameter of the center conductor 36; and $$v = \frac{1}{\sqrt{Ke}}$$

where v=velocity of propagation, and Ke=dielectric constant.

As shown and preferred in FIGS. 4 and 6, the spiral cut dielectric core 30, containing the inner conductor 36, is preferably inserted into a flexible outer conductor, such as a convoluted outer conductor 50, such as one preferably composed of a corrugated main conductive member 52 which has been corrugated to produce peaks 54 and valleys 56 in the conductive member 50 at a predetermined pitch, such as the outer conductive member described in the commonly owned U.S. Pat. Nos. 3,797,104 and 4,758,685, or a corrugated type conductor in which the flexible outer conductor is manufactured from a seamless or seamed tube. As with that outer conductive member, a helically wound conductive strip 58 preferably composed of the same conductive material as the main conductive member 52, is preferably helically wound about the main conductive member 52 so as to have the strip wound conductor 58 be helically wound about the peaks 54 of the corrugated main conductive member 52. The conductive strip 58 is preferably secured to these peaks 54, such as by soldering, so as to form a single unitary composite conductive member, such as disclosed in U.S Pat. Nos. 3,797,104 and 4,758,685, wherein the peaks 54 are accentuated by the helically wound strip 58 so as to increase the flexibility of the outer conductor 50. Although the convolutions in the flexible outer conductor 50 are shown as helical, they can be angular instead without departing from the present invention.

Although additional electrical stability may be provided for the resultant flexible coaxial cable 38 by locking the convoluted outer conductor 50 to the inserted spiral cut dielectric core 30, if such additional stability is not needed, such as if a change of 15 degrees in phase were tolerable, then the outer conductor 50 need not be locked to the inserted spiral cut dielectric core 30 and the resultant flexible coaxial cable 38 can still be a fast cable without locking. However, if such additional electrical stability is desired, then the convoluted outer conductor 50 is preferably locked to the spiral cut dielectric core 30 by any desired locking method such as, by way of example, the mechanical locking method disclosed in commonly owned U.S. Pat. Nos. 3,797,104 and 4,758,685 and illustrated in FIGS. 5 and 6, or the threadable locking method disclosed in the commonly owned contemporaneously filed U.S. Patent application entitled "Method of Making Flexible Coaxial Cable Having Threaded Dielectric Core," and illustrated in FIGS. 7–10. In either event, the locked cable 38 is then preferably temperature cycled in a conventional temperature chamber 60 over a temperature range of −60 degrees C. to +150 degrees C. for 48 hours, by way of example, to provide temperature stability for the locked cable 38.

With respect to the mechanical locking method illustrated in FIGS. 5 and 6, the outer conductor 50 is preferably mechanically crimped to the inserted spiral cut dielectric core 30 in the manner described in commonly owned U.S. Pat. Nos. 3,797,104 and 4,758,685, in accordance with the desired characteristic impedance of the resultant cable 38 such as by using a conventional time domain reflectometer 62 and mechanical crimping means 64, with the crimping points preferably being in the valleys 56 of the outer conductor 50. Since, as shown, the cut dielectric core 30 is a spiral or helix, depending on its pitch, the mechanical locking may be enhanced by the webs 42 filling additional voids in the interior of the outer conductor 50 between adjacent valleys 56, since the inside diameter of the cuter conductor 50 is preferably substantially the same as the outermost outside diameter of the inserted cut dielectric core 30.

Figure 10:
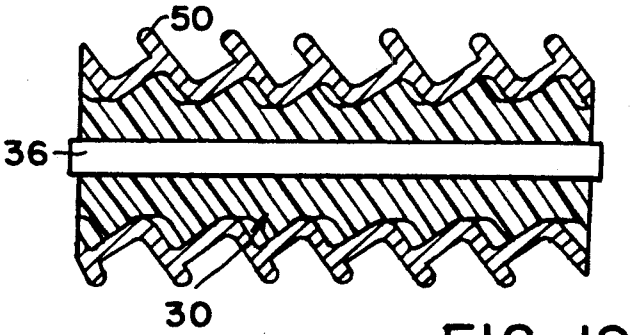
FIG. 10 is a cross sectional view of a preferred embodiment of a flexible coaxial cable produced by the improved method of the present invention, in which the threadable locking step of FIGS. 7 and 8 has been employed and the pitch of the cut dielectric core is different from the pitch of the convoluted outer conductor.
Figure 9:
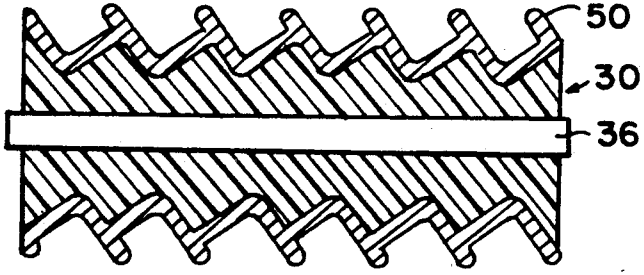
FIG. 9 is a cross sectional view of a preferred embodiment of a flexible coaxial cable produced by the improved method of the present invention, in which the threadable locking step of FIGS. 7 and 8 has been employed and the pitch of the cut dielectric core is the same as the pitch of the convoluted outer conductor.
Figure 8:
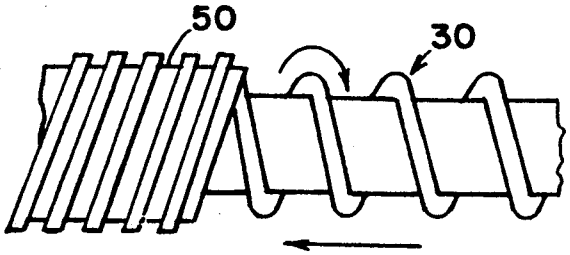

With respect to the threadable locking method illustrated in FIGS. 7–10, if this method is to be employed then preferably the outermost diameter $d_3$ of the spiral cut dielectric core 30 is larger than the inside diameter $d_2$ of the convoluted outer conductor 50 with the peak-to-peak of the webs 42 preferably being 2/1000–5/1000 larger than the inside diameter $d_2$ of the outer conductor 50. The spiral cut dielectric core 30 is then threaded into the outer conductor 50, as shown in FIG. 8, or vice versa, which locks the core 30 and the outer conductor 50 together as shown in FIGS. 9 and 10, by way of example, with FIG. 9 illustrating the locking of the core 30 to the outer conductor 50 when both have the same pitch, and with FIG. 10 illustrating the locking of the core 30 to the outer conductor 50 when the pitch of the core 30 is different from the pitch of the outer conductor 50. It should be noted that both cf the above locking methods are applicable whether the electrical starting material 32 was a spline or a cylindrical dielectric.

Figure 13:
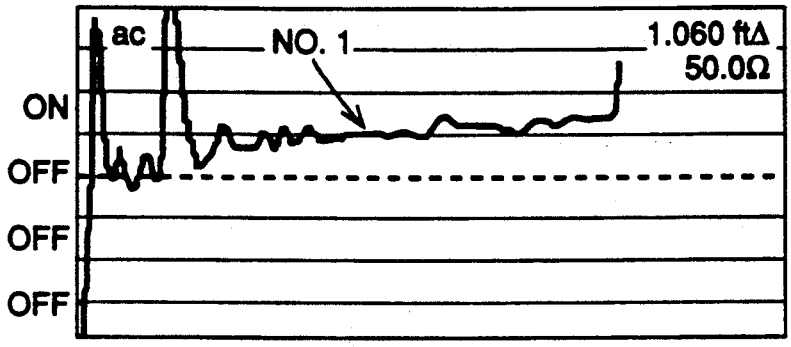
FIG. 13 is a graphical illustration of an impedance trace for a typical flexible coaxial cable produced in accordance with the improved method of the present invention in which a solid dielectric has been controllably cut to form a spiral or helix dielectric core which has been locked to the convoluted outer conductor.
Figure 14:
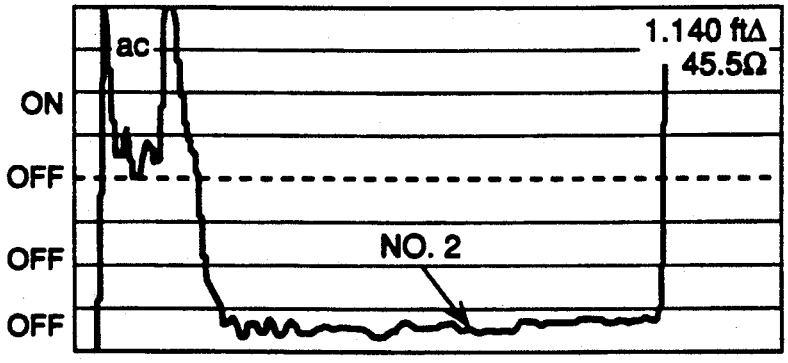
FIG. 14 is a graphical illustration, similar to FIG. 13, of an impedance trace for a typical flexible coaxial cable in which the solid dielectric core has not been cut and has not been locked to the convoluted outer conductor.
Figure 15:
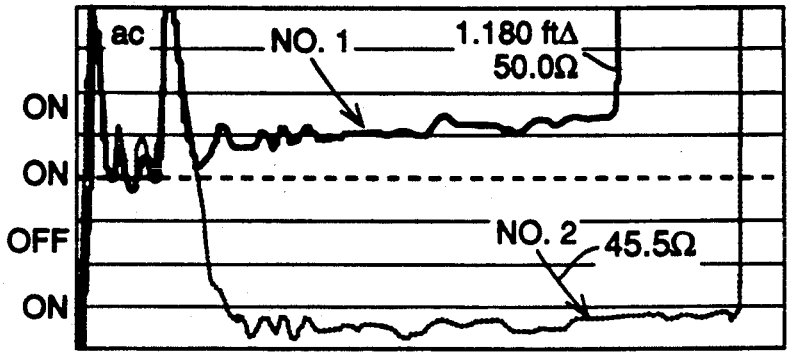
FIG. 15 is a graphical illustration, similar to FIGS. 13 and 14, which superimposes the graphs of FIGS. 13 and 14 to illustrate the changes in impedance and velocity of propagation which occur in the cable of FIG. 14 when the improved method of the present invention is employed to produce the cable of FIG. 13.

As noted above, by adjusting the cutting saw blades 34 to various angles, depths, etc., in accordance with the method of the present invention, the user can controllably change not only the shape and pitch of the spiral, but also the quantity of dielectric which is removed. As shown in FIGS. 13–21, this enables control over the velocity of propagation, the impedance, the attenuation, the phase length, and the VSWR of the resultant cable 38. For example, as shown in FIGS. 13–15, if the velocity of propagation of a coaxial cable with a solid dielectric is at 73% (FIG. 14) it can readily be controllably raised to 85% (FIG. 13) with controlled cutting of the dielectric starting material 32, while the resultant impedance is changed from 45.5 ohms to 50 ohms, with FIG. 14 comprising an impedance trace for a coaxial cable having a solid dielectric which is not locked to the convoluted outer conductor 50, and with FIG. 13 comprising an impedance trace for a coaxial cable 38, in accordance with the present invention, in which an inserted spiral cut dielectric core 30 is locked to the convoluted outer conductor 50. FIG. 15 shows the graphs of FIGS. 13 and 14 superimposed on each other.

Figure 16:
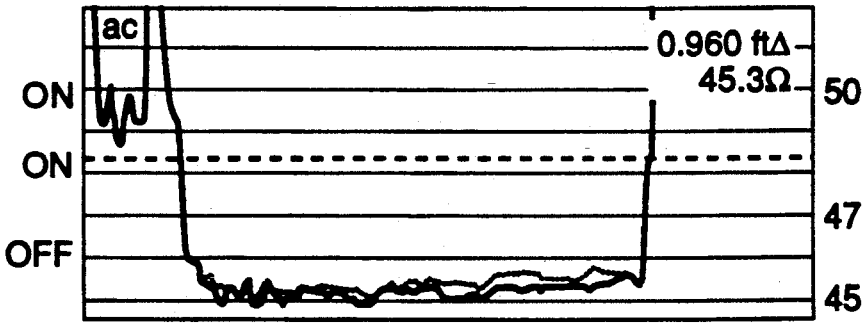
FIG. 16 is a graphical illustration, similar to FIG. 14, of an impedance trace for a different typical flexible coaxial cable in which the solid dielectric core has not been cut.
Figure 18:
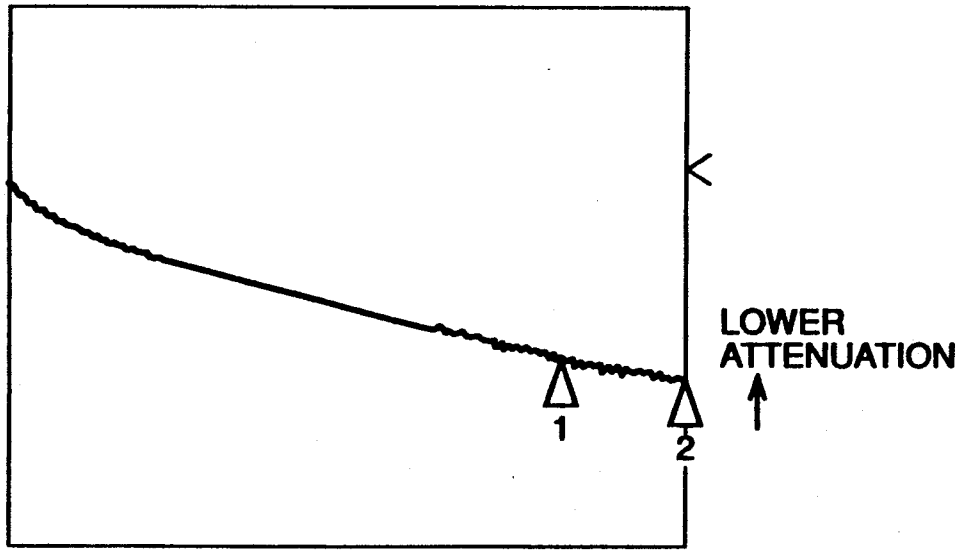
FIG. 18 is a graphical illustration of the attenuation curve for the cable of FIG. 16.
Figure 19:
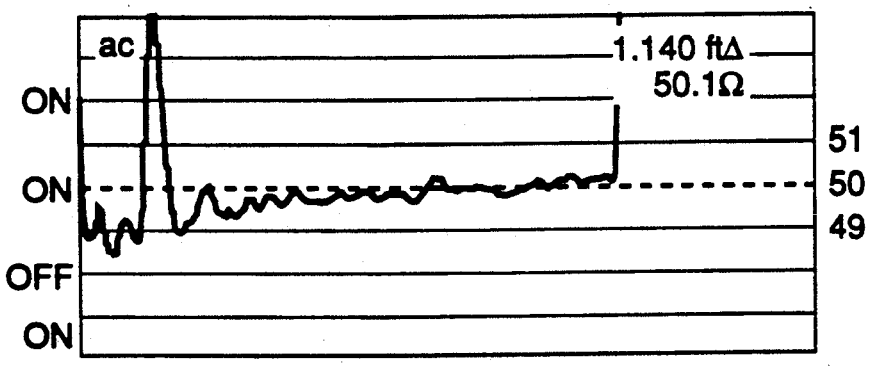
FIG. 19 is a graphical illustration, similar to FIG. 13, cf an impedance trace for a different typical flexible coaxial cable produced in accordance with the improved method to the present invention in which the solid dielectric has been controllably cut to form a spiral cut dielectric core.
Figure 21:
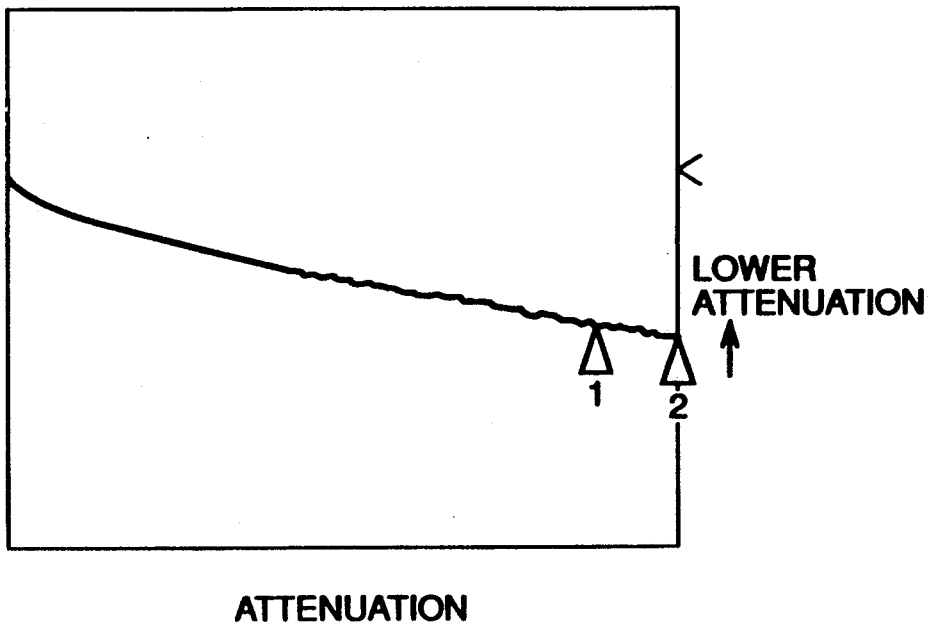
FIG. 21 is a graphical illustration of the attenuation curve for the cable of FIG. 19.
Figure 20:
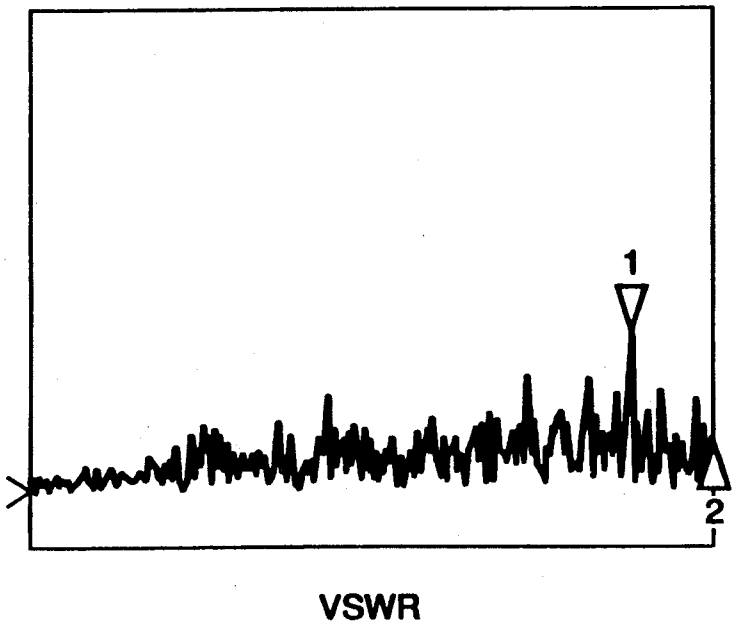
FIG. 20 is a graphical illustration of the VSWR curve for the cable of FIG. 19.

FIGS. 16 and 19 comprise additional impedance traces for a different dielectric core 30 in which FIG. 16 illustrates the impedance trace for the solid dielectric starting material 32 before cutting in which the velocity of propagation is at 71% and the resultant impedance is 45.3 ohms, and FIG. 19 illustrates the impedance trace of the resultant cable 38 after the solid dielectric starting material 32 has been controllably cut to produce a spiral cut dielectric core which has a velocity of propagation of 85% and a resultant impedance of 50.1 ohms. In addition, FIG. 17 illustrates a VSWR before cutting at 1.333 with the frequency of the highest VSWR at 14.82275 GHz, and FIG. 18 illustrates an attenuation of 58 db/100 ft. or −2.03 db at 18 GHz before cutting. By contrast, FIG. 20 illustrates a desired lower VSWR after cutting of 1.2822 with the frequency of the highest VSWR being at 15.89675 GHz, and FIG. 21 illustrates a desired lower attenuation of 47 db/100 ft or −1.64 db at 18 GHz after cutting.

Thus, the presently preferred method of the present invention allows various electrical parameter of the resultant cable 38, such as impedance, velocity of propagation or phase length, attenuation and VSWR to be determined in advance of manufacture, and to be readily achieved from a solid dielectric starting material 32 by a controlled cutting of this material 32 to any desired shape and configuration to provide a spiral cut dielectric core 30, having an inner conductor 36 which may readily be assembled with a convoluted outer conductor 50 to provide a fast cable which is a stable flexible coaxial cable 38 which may be rendered even more stable by locking the core 30 to the outer conductor 50. Although Teflon is presently preferred as the dielectric starting material, other dielectric materials such as polyethylene, TFE or FEP can also readily be shaped and cut in accordance with the method of the present invention. Moreover, if desired, portions of the solid dielectric 32, which may be a spline dielectric or an expanded dielectric, may also be cut out in order to introduce more air into the cable 38.

Summarizing the preferred method of the present invention, a solid dielectric starting material having a bonded center conductor is controllably cut with saw blades to a desired pitch and shaped by varying the cutting angle and the cutting width, the spiral cut dielectric core is then inserted into the convoluted outer conductor and, assuming additional stability is desired, is locked to the outer conductor and the resultant locked cable is temperature cycled to provide temperature stability for the cable.

By utilizing the method of the present invention, with the outer conductor remaining a constant size, after appropriate cutting of the solid dielectric starting material, the dielectric constant (Ke) can be lowered, the dielectric losses or attenuation can be lowered, the VSWR can be lowered, the electrical length can be decreased and the velocity of propagation can be increased. In addition, a larger center conductor may be employed thereby decreasing conductor losses and attenuation. Thus, these parameters may be more readily controlled during manufacture to provide a stable flexible coaxial cable. It should be noted that although the method of the present invention has been described with respect to manufacturing a flexible coaxial cable, it is also applicable to the manufacture of rigid or semi-rigid coaxial cable in which the core is to be shaped or cut as described herein.

What is claimed is:

1. A flexible coaxial cable which comprises:

an inner conductor;

a shaped dielectric core comprising a solid dielectric material, having a density, secured to said inner conductor, said shaped dielectric core having a spiral or helix groove with a predetermined pitch for providing a desired predetermined velocity of propagation and impedance for said coaxial cable, said shaped dielectric core being formed by controllably cutting a dielectric starting material, having a density, at a desired controllable predetermined cutting angle and width for cutting away a predetermined amount of said dielectric starting material, said solid dielectric material of said shaped core having substantially the same density as said dielectric starting material; and a flexible outer conductor.

2. A flexible coaxial cable in accordance with claim 1 wherein said shaped dielectric core is formed by cutting away said predetermined amount of said dielectric starting material for providing said desired predetermined impedance, Z, in accordance with the expression $$Z = \frac{138\mathrm{LOG}_{10}\frac{b}{a}}{\sqrt{Ke}}$$

where "Ke" represents the dielectric constant of said dielectric starting material, "b" represents the electric diameter of said outer conductor, and "a" represents the electrical outer diameter of said inner conductor.

3. A flexible coaxial cable in accordance with claim 2 wherein said shaped dielectric core is formed by cutting away said predetermined amount of said dielectric starting material for providing said desired predetermined velocity of propagation, v, in accordance with the expression $$v = \frac{1}{\sqrt{Ke}}$$

where "Ke" represents the dielectric constant of said solid dielectric material.

4. A flexible coaxial cable in accordance with claim 1 wherein said shaped dielectric core is formed by cutting away said predetermined amount of said dielectric starting material for providing said desired predetermined velocity of propagation, v, in accordance with the expression $$v = \frac{1}{\sqrt{Ke}}$$

where "Ke" represents the dielectric constant of said starting material.

5. A flexible coaxial cable in accordance with claim 1 wherein said dielectric core is inserted in said flexible outer conductor and locked thereto.

6. A flexible coaxial cable in accordance with claim 1 wherein said dielectric starting material is a spline solid.

7. A flexible coaxial cable in accordance with claim 1 wherein said dielectric starting material is a cylindrical solid.

8. A flexible coaxial cable in accordance with claim 1 wherein said shaped dielectric core comprises a single helix shaped dielectric core.

9. A flexible coaxial cable in accordance with claim 1 wherein said shaped dielectric core comprises a double helix shaped dielectric core.

10. A flexible coaxial cable in accordance with claim 1 wherein said shaped dielectric core is formed by spirally cutting said dielectric starting material.

11. A flexible coaxial cable in accordance with claim 1 wherein said shaped dielectric core is formed by spirally cutting an expanded solid dielectric starting material.

12. A flexible coaxial cable in accordance with claim 1 wherein said dielectric starting material is cut away to expose a portion of said inner conductor.

* * * * *